US008919984B1

(12) United States Patent
Fitzgerald

(10) Patent No.: US 8,919,984 B1
(45) Date of Patent: Dec. 30, 2014

(54) MULTIPLE LIGHT SOURCE CAP DEVICE WITH SHORT AND LONG RANGE LIGHTING

(75) Inventor: Robert Fitzgerald, N. Barrington, IL (US)

(73) Assignee: Outdoor Cap Co., Inc., Bentonville, AR (US)

( * ) Notice: Subject to any disclaimer, the term of this patent is extended or adjusted under 35 U.S.C. 154(b) by 51 days.

(21) Appl. No.: 13/439,297

(22) Filed: Apr. 4, 2012

Related U.S. Application Data

(60) Provisional application No. 61/471,480, filed on Apr. 4, 2011.

(51) Int. Cl.
*F21V 21/084* (2006.01)
*A42B 1/24* (2006.01)

(52) U.S. Cl.
CPC ..... *A42B 1/244* (2013.01)
USPC . 362/106; 362/105; 362/249.01; 362/249.02; 362/287

(58) Field of Classification Search
CPC .... A42B 1/0446; A42B 1/244; F21V 21/084; F21V 21/30; F21V 21/145; F21V 23/00; F21L 4/00
USPC ..... 362/105, 106, 139, 191, 249.01, 362/249.02, 276, 287, 427, 800, 802
See application file for complete search history.

(56) References Cited

U.S. PATENT DOCUMENTS

| | | | | |
|---|---|---|---|---|
| 4,991,068 | A * | 2/1991 | Mickey | 362/106 |
| 5,463,538 | A * | 10/1995 | Womack | 362/106 |
| 5,741,060 | A | 4/1998 | Johnson | |
| 6,056,413 | A | 5/2000 | Urso | |
| 6,616,293 | B2 * | 9/2003 | Mickey | 362/106 |
| 6,659,618 | B2 | 12/2003 | Waters | |
| 6,704,044 | B1 * | 3/2004 | Foster et al. | 348/157 |
| 6,733,150 | B1 | 5/2004 | Hanley | |
| 6,994,445 | B1 | 2/2006 | Pomes | |
| 7,086,749 | B1 * | 8/2006 | Hanley | 362/105 |
| 7,506,992 | B2 * | 3/2009 | Carter | 362/105 |
| 7,621,000 | B1 * | 11/2009 | Fulton | 2/209.13 |
| 7,677,751 | B2 * | 3/2010 | Kinsman et al. | 362/105 |
| 7,753,547 | B2 | 7/2010 | Waters | |
| 2010/0214767 | A1 | 8/2010 | Waters | |
| 2010/0307931 | A1 | 12/2010 | Waters | |
| 2010/0313335 | A1 * | 12/2010 | Waters | 2/209.13 |
| 2011/0122601 | A1 | 5/2011 | Waters | |

* cited by examiner

*Primary Examiner* — Hargobind S Sawhney
(74) *Attorney, Agent, or Firm* — Head, Johnson & Kachigian, P.C.

(57) ABSTRACT

A multiple light source cap device with short and long range lighting. The cap device includes a brim extending forwardly from a crown. A first light source is integral with a forward part of the brim, the first light source projecting light in a forward direction aligned with and projecting from the brim. A second light source in the brim projects light at a downward angle to the first light source forward direction. A third light source in the brim projects light at a downward angle from the second light source downward angle.

10 Claims, 4 Drawing Sheets

MULTIPLE LIGHT SOURCE CAP DEVICE WITH SHORT AND LONG RANGE LIGHTING

CROSS-REFERENCE TO RELATED APPLICATIONS

This application claims priority to U.S. Provisional Application Ser. No. 61/471,480, filed Apr. 4, 2011, which is incorporated herein by reference.

BACKGROUND OF THE INVENTION

1. Field of the Invention

The present invention relates to a hands free lighting device in the form of a multiple light source cap device with short and long range lighting which provides a continuous wide range of illumination. In particular, the present invention provides a multiple light source cap device with short and long range lighting wherein multiple light sources are integrated into and within a brim of a cap device.

2. Prior Art

Various different types of lighted headwear have been proposed in the past. Lighted headwear may be utilized when working in dark areas in order to avoid carrying a lantern, flashlight or other light source. Lighted headwear may also be utilized when reading or working at close range in low light level conditions.

One group of lighted headwear includes one or more light sources which project forwardly from a brim of the headwear. In general, the light is projected forwardly in a direction in a plane with the brim. Examples of lighted headwear with forward illumination include U.S. Pat. No. 6,733,150 and U.S. Pat. No. 7,086,749 entitled HEADWEAR WITH A FORWARD ILLUMINATION. These are particularly useful for viewing items ahead of the user, such as when hiking or when engaged in other outdoor activities.

Another group of lighted headwear includes one or more light sources which project downwardly from a brim. An example of under brim lighting may be seen in U.S. Patent Publication No. 2010/0214767. Urso (U.S. Pat. No. 6,056,413) discloses a lighted cap with the light source under the brim wherein the angle may be adjusted. Johnson (U.S. Pat. No. 5,741,060) discloses a pair of lamps on a mounting plate beneath a cap bill. This group of lighted headwear is particularly useful for reading and for other similar activities. Additionally, a few types of lighted headwear include multiple light sources. These headwear, however, also provide gaps or dark spots so that a complete field of view is lacking.

In each of the foregoing examples, the user is required to adjust the headwear or move his or her head in order to adjust the light to the desired viewing.

Nevertheless, there remains a need for a lighted cap device with a continuous wide range of illumination without dark spots or dark areas.

Accordingly, it is a principal object and purpose of the present invention to provide a multiple light source cap device with short and long range lighting having a continuous wide range of illumination from illumination projecting forward to illumination projecting downward.

There are a variety of prior designs for lighted headwear, which in all cases use many separate components, such as LEDs, switches, and wiring. Most of these designs connect the components to the brim. This leads to issues with quality both during assembly and use.

U.S. Pat. No. 5,741,060 illustrates two lights affixed to the underside of the brim by fasteners, which is bulky and not aesthetically pleasing.

In another example, U.S. Pat. No. 6,056,413 also has a light under the brim of the cap. Again, the lighting unit is separate from the cap/hat and is affixed using rivets. The aesthetic of this design is also less than desirable.

In the example, U.S. Pat. No. 6,994,445, there is an LED light assembly embedded into the brim material only in a horizontal position or a 90 degree position, nothing in between, and is completely or substantially recessed into the brim. In addition, the light source is always fixed in a single position and has a cover over the light source. This cover which is translucent can be damaged easily and is attached to the lighting unit so during the actual construction of the cap/hat the under visor cap/hat material will hang loose away from the lighting assembly or the fabric must be glued to the assembly, again excessive amounts of glue being the problem.

There remains a need for a multiple light source cap device where in the components are integrated into a single unit.

It is a further object and purpose of the present invention to provide a multiple light source cap device having multiple light sources utilizing light emitting diodes.

It is a further object and purpose of the present invention to provide a multiple light source cap device including an actuation switch mechanism and a mechanism to adjust the brightness of the multiple light sources.

It is a further object and purpose of the present invention to provide a multiple light source cap device wherein all of the light sources are integral in and with a brim of the cap device.

SUMMARY OF THE INVENTION

The present invention is directed to a multiple light source cap device. The cap device includes a crown for receipt on a head of a user. Extending forwardly from the crown is a brim having a rear edge attached to the crown and an opposed front edge.

The multiple light source cap device includes a first light source integral with the front edge of the brim. The first light source projects light in a forward direction aligned with and projecting from the brim. In a preferred embodiment, the first light source is a light emitting diode.

The multiple light source cap device also includes a second light source which is integral with the brim. The second light source projects light at a downward angle to the first light source forward direction.

The multiple light source cap device also includes a third light source integral with the brim. The third light source projects light at a downward angle to the first light source forward direction and at a downward angle to the second light source downward direction. Together, the multiple light sources provide a continuous wide range of illumination of over 90°.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
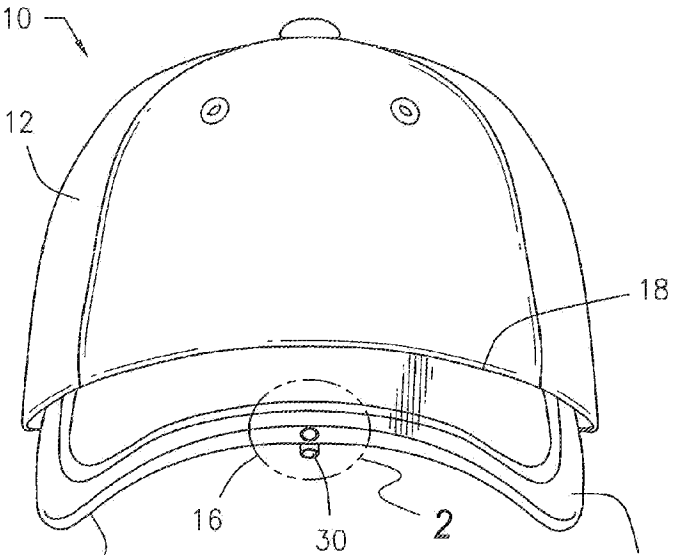
FIG. 1 is a front view of a multiple light source cap device with short and long range lighting constructed in accordance with the present invention.

Referring to the drawings in detail, FIG. 1 illustrates a front view of a multiple light source cap device 10 constructed in accordance with the present invention. The cap device 10 includes a crown 12 for receipt on the head of a user (not shown). Extending forwardly from the crown 12 is a brim 14. The brim 14 has a rear edge 18 attached to the crown and an opposed front edge 22. The device 10 is shown and described with a baseball style cap although the invention may be utilized with other types of headwear.

Figure 2:
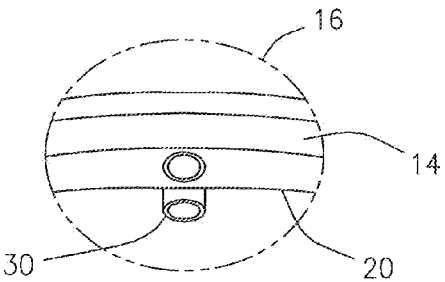
FIG. 2 illustrates an enlarged portion of a brim of a cap device as depicted within the dashed lines of FIG. 1.

FIG. 2 illustrates an enlarged portion of the brim 14 of the cap device 10 as depicted within the dashed lines 16 of FIG. 1.

Figure 3:
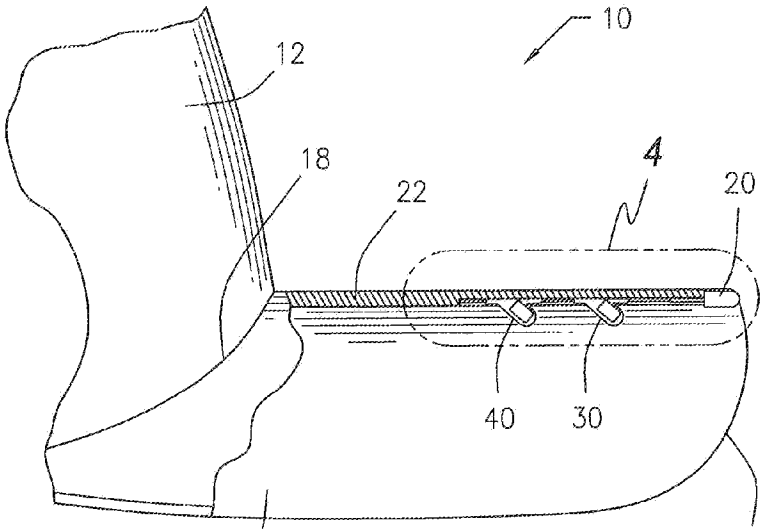
FIG. 3 illustrates a side view of a portion of the cap device shown in FIG. 1 with portions of the brim cut away.

FIG. 3 illustrates a side view of a portion of the cap device 10 shown in FIG. 1 with portions of the brim 14 cut away for ease of viewing.

Figure 4:
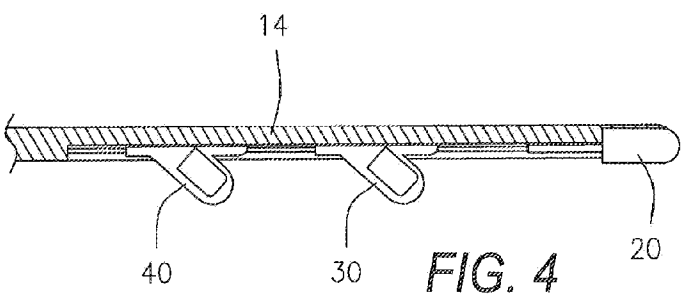
FIG. 4 illustrates an enlarged view of a portion of the brim shown in FIG. 3.

FIG. 4 illustrates an enlarged view of a portion of the brim 14 of the cap device 10 as shown in FIG. 3.

The multiple light source cap device 10 includes a first light source 20 which is integral with the front edge 22 of the brim 14. The first light source 20 projects light in a forward direction substantially aligned with and projecting from the brim.

In a preferred embodiment, the first light source 20 is a light emitting diode (LED) although other types of light sources are possible within the spirit and scope of the invention.

In an alternate embodiment, the first light source 20 includes multiple light emitting diodes (not shown). For example, three light emitting diodes may be arranged projecting forwardly.

The multiple light source cap device 10 also includes a second light source 30 which is integral with the brim 14. The second light source projects light at a downward angle to the first light source forward direction. In a preferred embodiment, the second light source 30 is a light emitting diode.

In at least one preferred embodiment, the second light source 30 projects light downward at an angle from between 30 and 45 degrees from the first forward light source 20.

The multiple light source cap device 10 also includes a third light source 40 which is integral with the brim 14. The third light source projects light at a downward angle to the first light source forward direction and at a downward angle to the second light source downward direction. In a preferred embodiment, the second light source 30 is a light emitting diode.

In at least one preferred embodiment, the third light source 40 projects light downward at an angle from between 30° and 45° from the first forward light source 20.

Figure 5B:
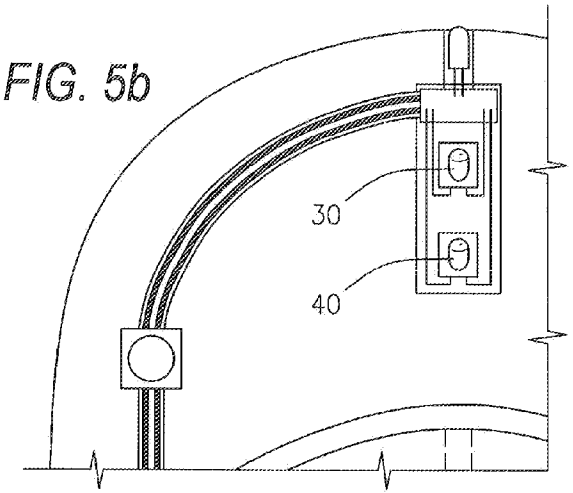
FIG. 5 illustrates a diagrammatic view of the underside of the multiple light source cap device shown in FIG. 1.
Figure 5C:
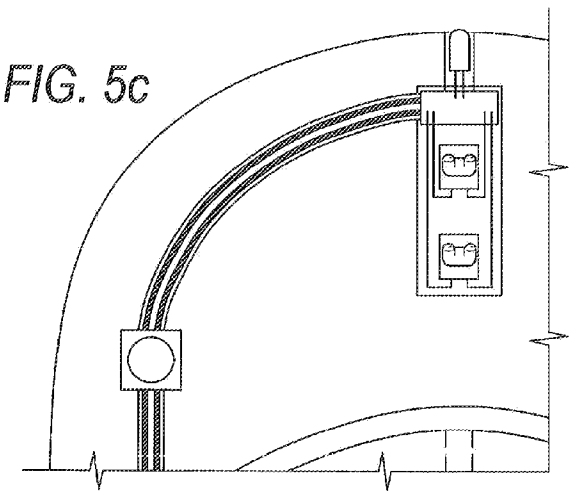
Figure 5A:
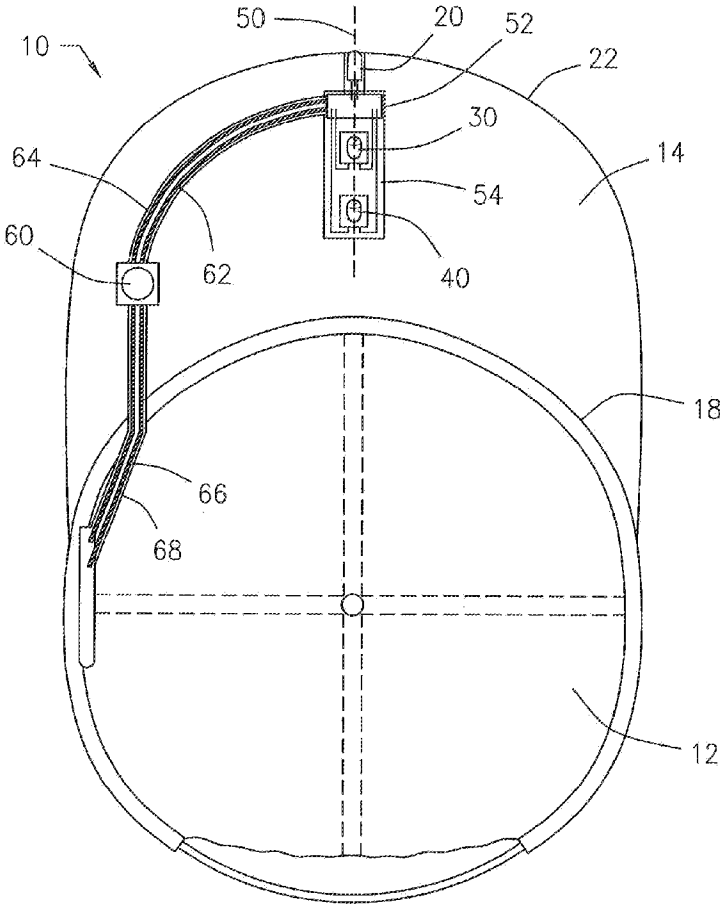

FIG. 5 illustrates a schematic diagrammatic view of the underside of the multiple light source cap device 10. As can be easily seen in FIG. 5, each of the light sources 20, 30 and 40 are aligned along a line shown at dashed line 50 which extends from the front edge 22 of the brim to the rear edge 18 of the brim where the brim joins to the crown 12 of the cap device 10.

The light sources may be retained with a channel 52 or recess which also holds a circuit board 54.

As seen in FIG. 5, the first light source 20, second light source 30 and third light source 40 are wired to an actuation switch 60 via a wire or wires 62 which may reside in a channel 64.

The actuation switch 60 may be adapted to turn each of the light sources on and off each individually or together. In one configuration, the actuation switch is a button switch. Additionally, the actuation switch 60 may be arranged to change the brightness of each of the light sources.

The actuation switch 60 as well as the first light source 20, the second light source 30, and the third light source 40 are wired to a power source 66 such as a battery via a wire or wires 66 which may reside in a channel 68.

The present invention may be fabricated by integrating the light sources 20, 30 and 40, the switch 60, wires 62 and channel 64 in a single unit.

The present invention eliminates fasteners, including rivets and bolts, and minimizes or eliminates adhesives.

Figure 6:
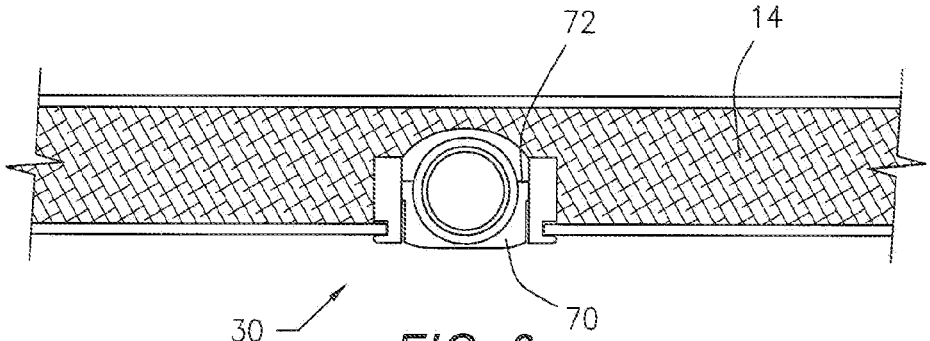
FIGS. 6, 7 and 8 illustrate a portion of brim with alternate positioning of lighting sources of the multiple light source cap device shown in FIG. 1.
Figure 7:
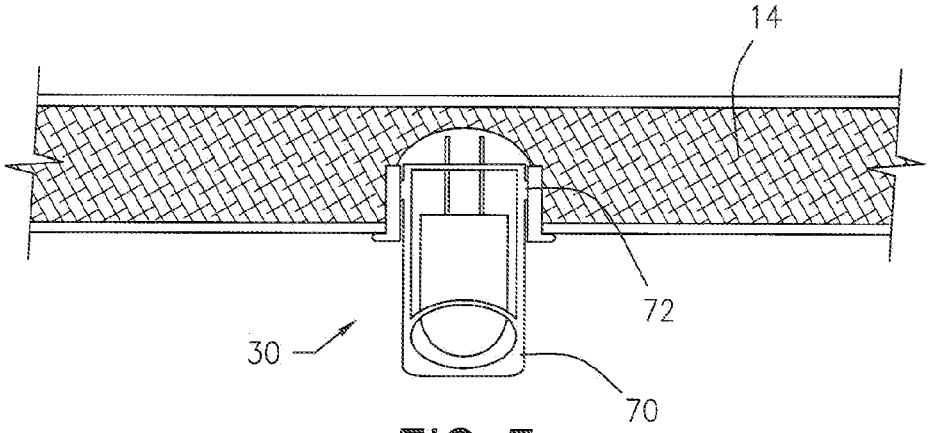
Figure 8:
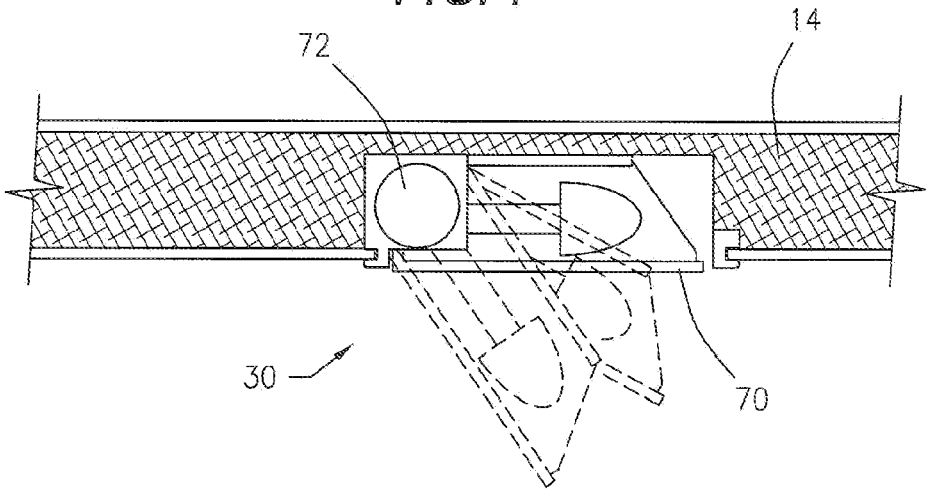

FIGS. 6, 7 and 8 illustrate a portion of the brim of the cap device 10 along with alternate positioning of the light emitting diodes.

For example, the second light source 30 may be contained within a housing 70 which rotates around a pivot or pivots 72 to adjust the angle of the projection of the light from the light source 30.

Figure 9:
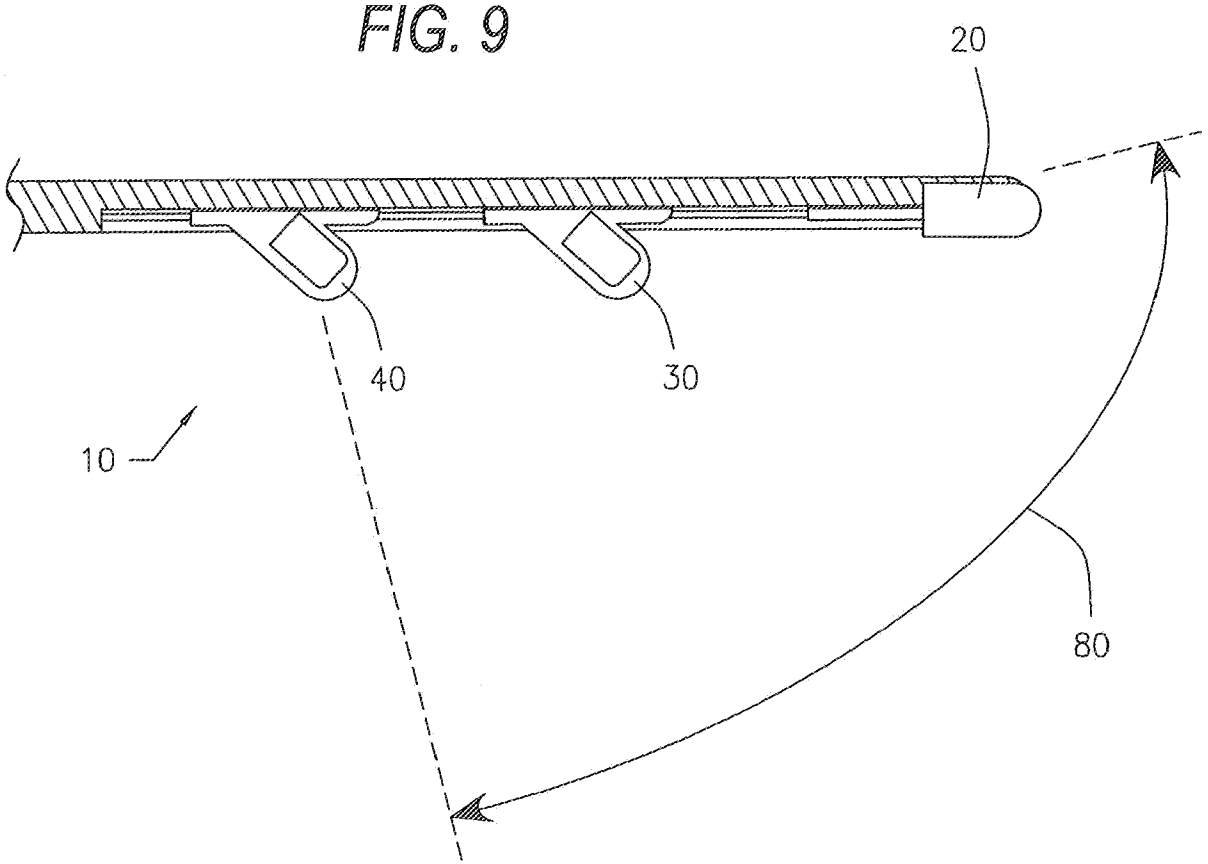
FIG. 9 illustrates a wide range of continuous illumination achieved by the multiple light source cap device.

FIG. 9 illustrates an example of one arrangement of the multiple light source cap device 10. With the three light sources, the first light source 20, the second light source 30 and the third light source 40, the cap device 10 projects a wide range of illumination as shown by arrow 80 of over 90°.

In one non limiting example, the cap device 10 provides a continuous wide range of illumination of over 90 degrees) (90°.

Whereas, the present invention has been described in relation to the drawings attached hereto, it should be understood that other and further modifications, apart from those shown or suggested herein, may be made within the spirit and scope of this invention.

What is claimed is:

1. A multiple light source cap device with short and long range lighting wherein said cap device includes a brim extending forwardly from a crown, which cap device comprises:

a first light source integral with a forward part of said brim, said first light source projecting light in a forward direction;

a second light source in said brim rearward of said first light source projecting light at a downward angle to said first light source forward direction, wherein said second light source downward angle is adjustable; and a third light source in said brim rearward of said second light source projecting light at a downward angle from said second light source downward angle, wherein said third light source downward angle is adjustable;

such that the first light source, the second light source, and the third light source are aligned along a line extending from a front edge of said brim to said crown and together provide continuous illumination of over 90 degrees vertically.

2. A multiple light source cap device as set forth in claim 1 wherein each said light source is at least one light emitting diode.

3. A multiple light source cap device as set forth in claim 1 wherein said first light source includes multiple light emitting diodes.

4. A multiple light source cap device as set forth in claim 1 including an actuation switch in said brim of said cap.

5. A multiple light source cap device as set forth in claim 1 wherein said actuation switch includes a mechanism to adjust the brightness of said first, second, and third light source.

6. A multiple light source cap device as set forth in claim 1 including a power source in said crown.

7. A multiple light source cap device as set forth in claim 1 wherein said second light source projects downward at an angle from between 30° to 45°.

8. A multiple light source cap device as set forth in claim 1 wherein said third light source projects downward at an angle from between 30° to 45°.

9. A multiple light source cap device as set forth in claim 1 including a mechanism to adjust the brightness of said first light source, said second light source, and said third light source.

10. A multiple light source cap device as set forth in claim 1 wherein said first light source, said second light source, and said third light source are each integral with said brim.

* * * * *